US009849676B2

(12) United States Patent
Morrison et al.

(10) Patent No.: US 9,849,676 B2
(45) Date of Patent: Dec. 26, 2017

(54) PRINTER INCLUDING A SPIT ZONE

(71) Applicant: HEWLETT-PACKARD DEVELOPMENT COMPANY, L.P., Houston, TX (US)

(72) Inventors: Randal Morrison, Vancouver, WA (US); Jafar N. Jefferson, Vancouver, WA (US); Lisa Michels, Vancouver, WA (US); Cris Jansson, Vancouver, WA (US); Bob Davis, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/082,715

(22) Filed: Mar. 28, 2016

(65) Prior Publication Data

US 2017/0274659 A1 Sep. 28, 2017

(51) Int. Cl.
*B41J 2/165* (2006.01)

(52) U.S. Cl.
CPC ..... *B41J 2/16505* (2013.01)

(58) Field of Classification Search
CPC ..... B41J 2/16505
USPC ..... 347/22, 31, 32, 35
See application file for complete search history.

(56) References Cited

U.S. PATENT DOCUMENTS

| | | | | |
|---|---|---|---|---|
| 5,500,659 | A | 5/1996 | Curran et al. | |
| 6,616,266 | B2 | 9/2003 | Neal et al. | |
| 7,798,601 | B2 | 9/2010 | Yoshikawa et al. | |
| 2003/0020777 | A1* | 1/2003 | Su | B41J 2/0456 347/19 |
| 2003/0020782 | A1* | 1/2003 | Neal | B41J 2/16508 347/35 |
| 2004/0109050 | A1 | 6/2004 | Yang | |
| 2005/0018009 | A1 | 1/2005 | Otsubo | |
| 2006/0109306 | A1 | 5/2006 | Jung | |
| 2011/0205292 | A1* | 8/2011 | Kneezel | B41J 2/16526 347/29 |

FOREIGN PATENT DOCUMENTS

| | | |
|---|---|---|
| CN | 203427456 | 2/2014 |

* cited by examiner

*Primary Examiner* — Huan Tran
*Assistant Examiner* — Alexander D Shenderov
(74) *Attorney, Agent, or Firm* — Dhand Law PC

(57) ABSTRACT

A printer includes a printhead assembly, a spit zone, and a controller. The printhead assembly includes nozzles to eject ink drops. The spit zone is to store maintenance ink. The controller is to move the printhead assembly over the spit zone while ink is ejected from the nozzles during spits.

13 Claims, 4 Drawing Sheets

PRINTER INCLUDING A SPIT ZONE

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

To maintain the heath of the nozzles of a printhead assembly, inkjet printers may eject ink from the nozzles during spits (i.e., outside of printing to a print medium). The ink ejected during spits (i.e., maintenance ink) is stored within the printer. When pigment ink is ejected from nozzles of a printhead assembly at a fixed location during a spit, the volatile components of the ink evaporate, leaving behind a semi-solid substance. Successive spits may cause a stalagmite like growth that may rapidly climb to a height that may cause problems within a printer. The growth may run into the carriage assembly, printhead assembly, or other moving parts of the printer, which may result in maintenance ink ending up on a printed page or cause a malfunction within the printer. In a small printer there is limited space available to store maintenance ink. In any printer, costs are incurred to design and include additional parts and features to move the accumulated maintenance ink out of the path of the printhead assembly and/or other printer components. In addition, mechanical designs to move the maintenance ink may behave in an unpredictable fashion and are sensitive to environmental factors and testing protocols.

Accordingly, instead of ejecting ink at a fixed location during spits, the example printers described herein include moving the printhead assembly during spits to evenly distribute the maintenance ink throughout a spit zone. No mechanical components are needed to move the maintenance ink out of the path of the printhead assembly and/or other printer components. Thus, compared to printers including mechanical components to move the maintenance ink, printers as described herein including spit zones where maintenance ink is distributed for storage use fewer parts and are more reliable, less expensive, and more conducive to a user or service-replaceable module.

Figure 1:
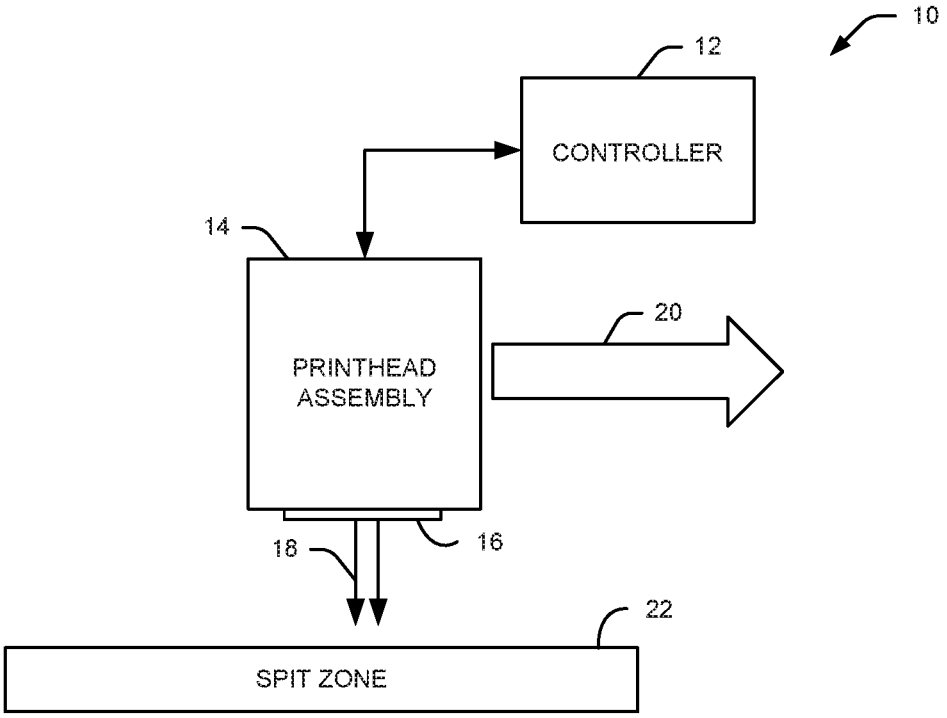
FIG. 1 is a block diagram illustrating one example of an inkjet printing system.

FIG. 1 is a block diagram illustrating one example of an inkjet printing system 10. Inkjet printing system 10 includes a controller 12, a printhead assembly 14, and a spit zone 22. Printhead assembly 14 includes nozzles 16 to eject ink drops as indicated at 18. Spit zone 22 is to store maintenance ink. Controller 12 is to move printhead assembly 14 over spit zone 22 as indicted at 20 while ink is ejected from nozzles 16 during spits.

Figure 1A:
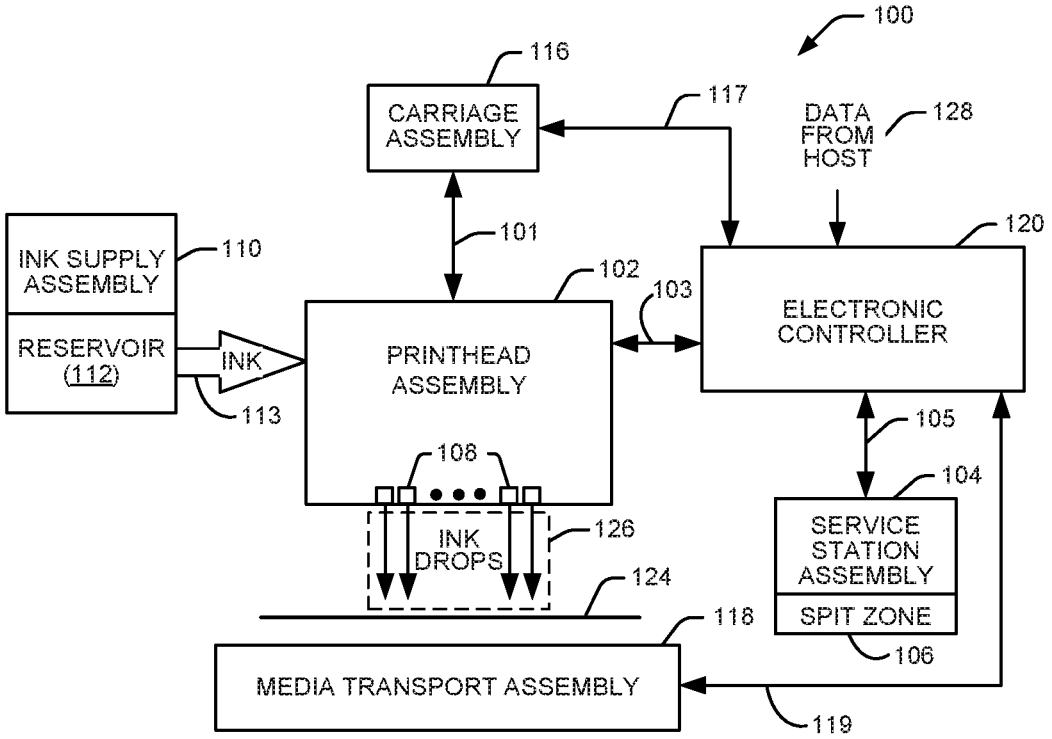
FIG. 1A is a block diagram illustrating another example of an inkjet printing system.

FIG. 1A is a block diagram illustrating another example of an inkjet printing system 100. Inkjet printing system 100 includes a fluid ejection assembly, such as printhead assembly 102, and a fluid supply assembly, such as ink supply assembly 110. In the illustrated example, inkjet printing system 100 also includes a service station assembly 104, a carriage assembly 116, a print media transport assembly 118, and an electronic controller 120. While the following description provides examples of systems and assemblies for fluid handling with regard to ink, the disclosed systems and assemblies are also applicable to the handling of fluids other than ink.

Printhead assembly 102 includes at least one printhead or fluid ejection device which ejects drops of ink or fluid through a plurality of orifices or nozzles 108. In one example, the drops are directed toward a medium, such as print media 124, so as to print onto print media 124. Print media 124 includes any type of suitable sheet material, such as paper, card stock, transparencies, Mylar, fabric, and the like. In one example, nozzles 108 are arranged in at least one column or array such that properly sequenced ejection of ink from nozzles 108 causes characters, symbols, and/or other graphics or images to be printed upon print media 124 as printhead assembly 102 and print media 124 are moved relative to each other.

Ink supply assembly 110 supplies ink to printhead assembly 102 and includes a reservoir 112 for storing ink. As such, in one example, ink flows from reservoir 112 to printhead assembly 102. In one example, printhead assembly 102 and ink supply assembly 110 are housed together in an inkjet or fluid-jet print cartridge or pen. In another example, ink supply assembly 110 is separate from printhead assembly 102 and supplies ink to printhead assembly 102 through an interface connection 113, such as a supply tube and/or valve.

Carriage assembly 116 positions printhead assembly 102 relative to print media transport assembly 118 and print media transport assembly 118 positions print media 124 relative to printhead assembly 102. Thus, a print zone 126 is defined adjacent to nozzles 108 in an area between printhead assembly 102 and print media 124. In one example, printhead assembly 102 is a scanning type printhead assembly such that carriage assembly 116 moves printhead assembly 102 relative to print media transport assembly 118.

Service station assembly 104 provides for spitting, wiping, capping, and/or priming of printhead assembly 102 to maintain the functionality of printhead assembly 102 and, more specifically, nozzles 108. For example, service station assembly 104 may include a rubber blade or wiper which is periodically passed over printhead assembly 102 to wipe and clean nozzles 108 of excess ink. In addition, service station assembly 104 may include a cap that covers printhead assembly 102 to protect nozzles 108 from drying out during periods of non-use. In addition, service station assembly 104 includes a spit zone 106 into which printhead assembly 102 ejects ink during spits to insure that reservoir 112 maintains an appropriate level of pressure and fluidity, and to insure that nozzles 108 do not clog or weep. Functions of service station assembly 104 may include relative motion between service station assembly 104 and printhead assembly 102.

Electronic controller 120 communicates with printhead assembly 102 through a communication path 103, service station assembly 104 through a communication path 105, carriage assembly 116 through a communication path 117, and print media transport assembly 118 through a communication path 119. In one example, when printhead assembly 102 is mounted in carriage assembly 116, electronic controller 120 and printhead assembly 102 may communicate via carriage assembly 116 through a communication path 101. Electronic controller 120 may also communicate with ink supply assembly 110 such that, in one implementation, a new (or used) ink supply may be detected.

Electronic controller 120 receives data 128 from a host system, such as a computer, and may include memory for temporarily storing data 128. Data 128 may be sent to inkjet printing system 100 along an electronic, infrared, optical or other information transfer path. Data 128 represent, for example, a document and/or file to be printed. As such, data 128 form a print job for inkjet printing system 100 and includes at least one print job command and/or command parameter.

In one example, electronic controller 120 provides control of printhead assembly 102 including timing control for ejection of ink drops from nozzles 108. As such, electronic controller 120 defines a pattern of ejected ink drops which form characters, symbols, and/or other graphics or images on print media 124. Timing control and, therefore, the pattern of ejected ink drops, is determined by the print job commands and/or command parameters. In one example, logic and drive circuitry forming a portion of electronic controller 120 is located on printhead assembly 102. In another example, logic and drive circuitry forming a portion of electronic controller 120 is located off printhead assembly 102.

Electronic controller 120 also controls printhead assembly 102 during spits for maintaining nozzles 108. Instead of ejecting ink drops from nozzles 108 at a fixed location within spit zone 106 during spits, electronic controller 120 moves printhead assembly 102 relative to spit zone 106 such that the ejected ink drops (i.e., maintenance ink) is distributed throughout spit zone 106. In one example, spit zone 106 has a volume large enough to store all the maintenance ink accumulated during the expected lifetime of printing system 100. In other examples, printing system 100 includes a user or service-replaceable spit zone module that may be periodically replaced when full of maintenance ink.

Figure 2A:
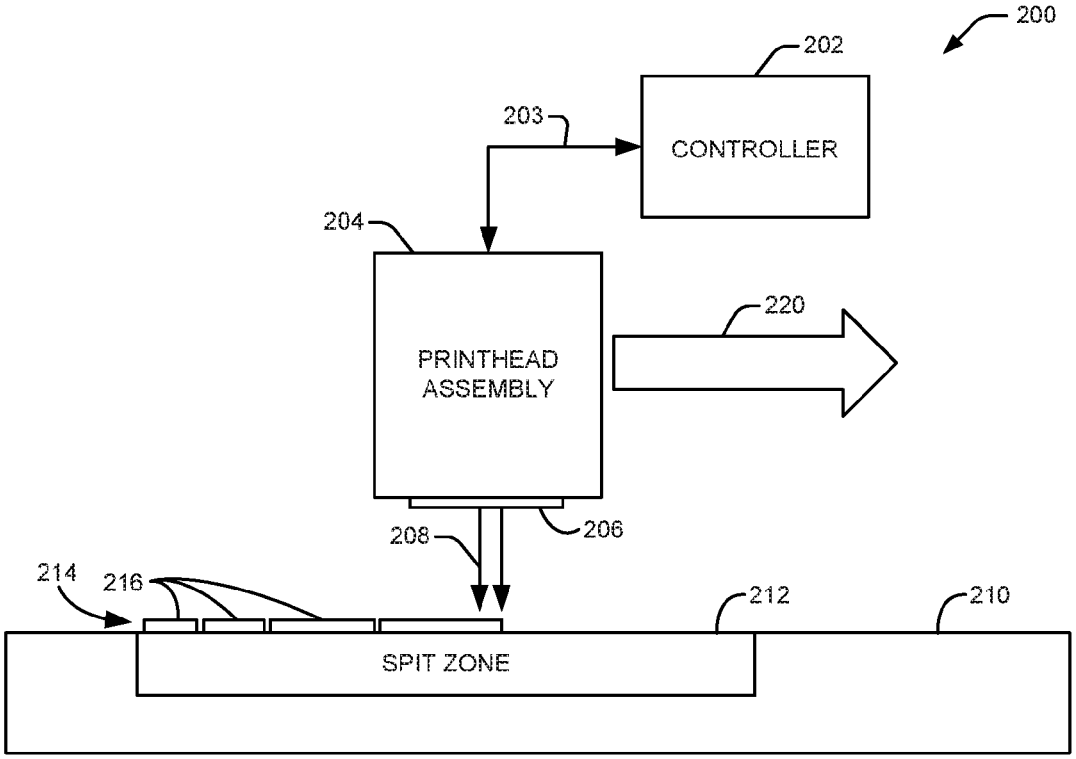
FIG. 2A is a block diagram illustrating one example of an inkjet printing system during a spit.

FIG. 2A is a block diagram illustrating one example of an inkjet printing system 200 during a spit. Printing system 200 includes a controller 202, a printhead assembly 204, and a service station assembly 210 including a spit zone 212. Printhead assembly 204 includes nozzles 206 to eject ink as indicated at 208. In one example, ink 208 is a pigment ink or another ink that leaves behind a semi-solid or solid substance once the volatile components of the ink evaporate. Controller 202 is communicatively coupled to printhead assembly 204 through a communication path 203 to control the movement of printhead assembly 204 and the ejection of ink drops from nozzles 206.

Spit zone 212 is located under the scanning path of printhead assembly 204. Spit zone 212 may include a recessed region or another suitable region under the scanning path of printhead assembly 204 capable of storing a predefined volume of maintenance ink. In one example, spit zone 212 is arranged outside a print zone of printhead assembly 204, such as between a print zone and a mechanical stop of printing system 200. In another example, spit zone 212 is arranged inside a print zone of printhead assembly 204 and controller 202 prevents spitting when a print medium is present within the print zone. While one spit zone 212 is illustrated in FIG. 2A, in other examples printing system 200 may include two spit zones or another suitable number of spit zones along the scanning path of printhead assembly 204.

Controller 202 controls the movement of printhead assembly 204 during a spit such that ink ejected from nozzles 206 of printhead assembly 204 is distributed within spit zone 212. Printhead assembly 204 may be moved at a constant speed over spit zone 212 during a spit. In one example, controller 202 sets a starting position for a spit within spit zone 212 based on the ending position for a previous spit within spit zone 212 to distribute the maintenance ink evenly over spit zone 212. Maintenance ink 214 may be stored in spit zone 212 in tile-like segments 216, where each tile-like segment 216 is formed during a single spit. Thus, in the example illustrated in FIG. 2A, spit zone 212 is storing maintenance ink 214 for four spits 216 of various lengths. In this example, printhead assembly 204 is moving over spit zone 212 to the right as indicated by arrow 220. Therefore, a subsequent spit may start next to a previous spit within spit zone 212 until the maintenance ink from subsequent spits reaches the right border of spit zone 212. Once spit zone 212 is mostly or completely covered by a first layer of maintenance ink 214, a second layer of maintenance ink may be stacked on the first layer during subsequent spits.

The length of each spit 216 is based upon the speed of printhead assembly 204 relative to spit zone 212 and the number of drops for the spit. For example, a flying spit (i.e., a spit during printing) including 20, 75, or 100 drops of ink with printhead assembly 204 moving at 2 inches per second (ips) relative to spit zone 212 may result in a spit length of 0.63, 1.25, or 1.53 mm, respectively. In another example, a spit after coming out of a printhead assembly cap including 150 or 500 drops of ink with printhead assembly 204 moving at 2 ips may result in a spit length of 2.10 or 6.05 mm, respectively. In another example, a spit prior to going into a printhead assembly cap including 200 or 500 drops of ink with printhead assembly 204 moving at 2 ips may result in a spit length of 2.66 or 6.05 mm, respectively. In another example, a pen recovery spit including 1000 drops of ink with printhead assembly 204 moving at 2 ips may result in a spit length of 11.69 mm. In other examples, spits may include a different number of drops of ink and/or printhead assembly 204 may move at another suitable speed relative to spit zone 212 to provide spits having different lengths.

Figure 2B:
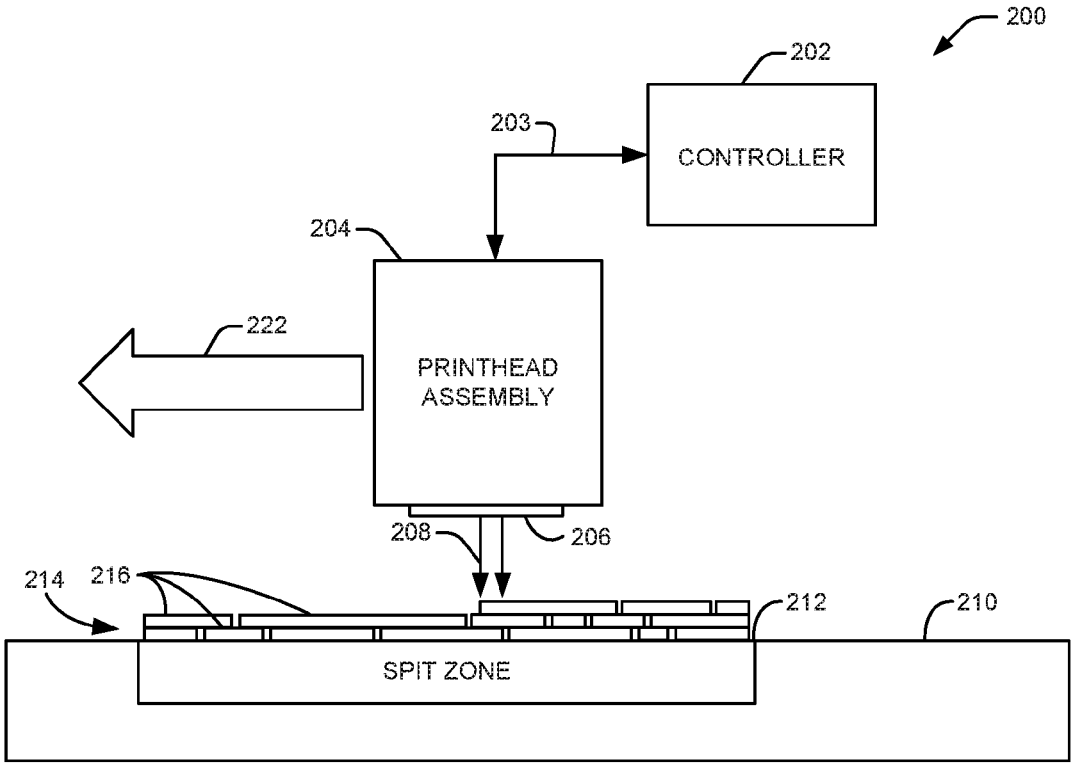
FIG. 2B is a block diagram illustrating another example of the inkjet printing system of FIG. 2A during a spit.

FIG. 2B is a block diagram illustrating another example of inkjet printing system 200 of FIG. 2A during a spit. In this example, controller 202 is moving printhead assembly 204 to the left relative to spit zone 212 during a spit as indicated by arrow 222. Also illustrated in FIG. 2B are multiple layers of maintenance ink 214 due to a plurality of spits 216 of various lengths distributed throughout spit zone 212.

Figure 3:
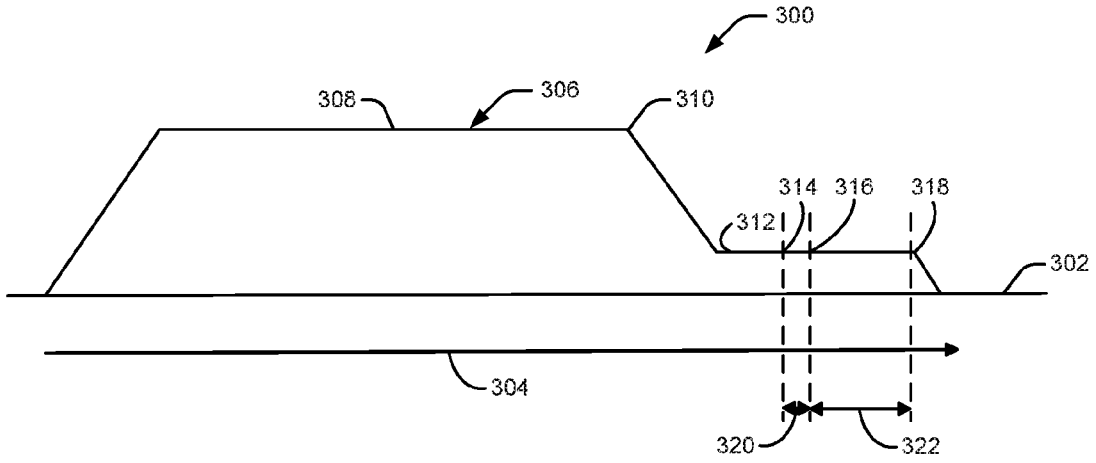
FIG. 3 is a chart illustrating one example of the movement of a printhead assembly for a spit.

FIG. 3 is a chart 300 illustrating one example of the movement of a printhead assembly for a spit, such as printhead assembly 102 previously described and illustrated with reference to FIG. 1A or printhead assembly 204 previously described and illustrated with reference to FIG. 2A. A carriage assembly axis, such as for carriage assembly 116 previously described and illustrated with reference to FIG. 1A, along which the printhead assembly may move, is indicated at 302. In this example, the direction of movement of the printhead assembly during the spit is to the right along carriage assembly axis 302 as indicated by arrow 304. In other examples, the direction of movement of the printhead assembly during the spit may be in the opposite direction along carriage assembly axis 302. The speed of the printhead assembly along carriage assembly axis 302 is indicated by 306.

Prior to a spit, the printhead assembly may be moving toward a spit zone at a first speed as indicated at 308, such as between 10 and 50 ips (e.g., 40 ips). At 310, as the printhead assembly nears or reaches the spit zone, the speed of the printhead assembly is modified to prepare for the spit. In one example, the location where the speed is modified is calculated based on the start position for the spit within the spit zone. The start position for the spit may be based upon the ending position of a prior spit. The speed of the printhead assembly is slowed to a second speed less than the first speed as indicated at 312, such as between 1 and 5 ips (e.g., 2 ips). At 314, the spit is evoked. After a predetermined delay indicated at 320 for the printhead assembly to start ejecting ink from the nozzles after the spit is evoked, the spit begins at 316. The spit continues for the length of the spit as indicated at 322 based on the number of ink drops for the spit and the speed of the printhead assembly relative to the spit zone. After the spit is completed at 318, the printhead assembly may be brought to a controlled stop.

Figure 4:
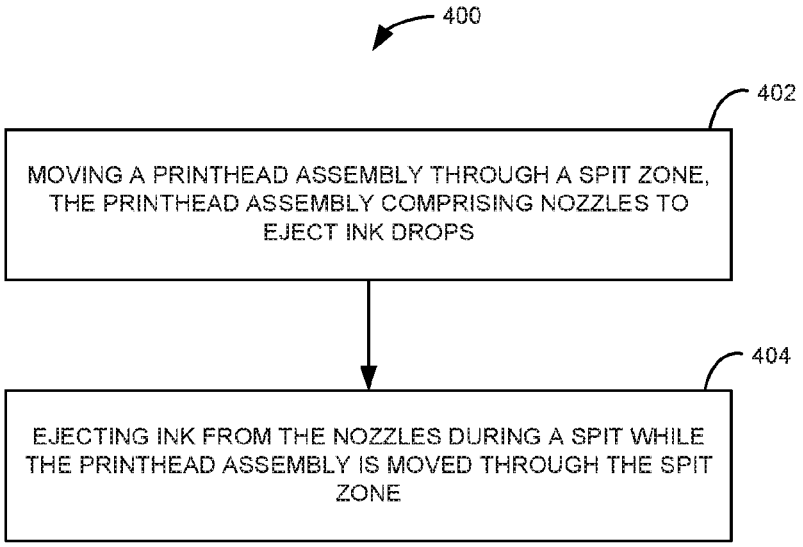
FIG. 4 is a flow diagram illustrating one example of a method for maintaining nozzles of a printhead assembly.

FIG. 4 is a flow diagram illustrating one example of a method 400 for maintaining nozzles of a printhead assembly. At 402, method 400 includes moving a printhead assembly through a spit zone, the printhead assembly comprising nozzles to eject ink drops. At 404, method 400 includes ejecting ink from the nozzles during a spit while the printhead assembly is moved through the spit zone. In one example, method 400 further includes setting a starting position within the spit zone for a subsequent spit based on an ending position within the spit zone of a previous spit such that ink from multiple spits is distributed throughout the spit zone. In another example, method 400 further includes moving the printhead assembly at a first speed prior to reaching the spit zone and moving the printhead assembly through the spit zone at a second speed less than the first speed.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printer comprising:

a printhead assembly comprising nozzles to eject ink drops;

a spit zone to receive maintenance ink from the nozzles; and a controller to move the printhead assembly over the spit zone while ink is ejected from the nozzles during spits, wherein the controller sets a starting position within the spit zone for a subsequent spit based on an ending position within the spit zone of a previous spit, and wherein the subsequent spit does not overlap the previous spit.

2. The printer of claim 1, wherein the controller is to move the printhead assembly over the spit zone while ink is ejected from the nozzles during spits such that the maintenance ink is distributed throughout the spit zone.

3. The printer of claim 1, wherein the controller is to move the printhead assembly over the spit zone in a first direction while ink is ejected from the nozzles during a first spit, and wherein the controller is to move the printhead assembly over the spit zone in a second direction opposite to the first direction while ink is ejected from the nozzles during a second spit.

4. The printer of claim 1, wherein the controller is to move the printhead assembly over the spit zone a first distance while ink is ejected from the nozzles during a first spit, and wherein the controller is to move the printhead assembly over the spit zone a second distance different from the first distance while ink is ejected from the nozzles during a second spit.

5. The printer of claim 1, wherein the spit zone is sized to store all maintenance ink accumulated due to spits over the life of the printer.

6. The printer of claim 1, further comprising:

a further spit zone to store maintenance ink.

7. A printer comprising:

a carriage assembly;

a printhead assembly coupled to the carriage assembly, the printhead assembly comprising nozzles to eject ink drops;

a spit zone to receive ink ejected from the nozzles during spits; and a controller to control the carriage assembly to move the printhead assembly over the spit zone while ink is ejected from the nozzles during spits, wherein the controller sets a starting position within the spit zone for a subsequent spit based on an ending position within the spit zone of a previous spit, and wherein the controller positions the subsequent spit to not overlap the previous spit.

8. The printer of claim 7, wherein the controller is to control the carriage assembly to move the printhead assembly over the spit zone while ink is ejected from the nozzles during spits such that the ink is distributed throughout the spit zone.

9. The printer of claim 7, wherein the ink comprises a pigment ink.

10. The printer of claim 7, wherein the spit zone is arranged outside a print zone of the printhead assembly.

11. The printer of claim 7, wherein the spit zone is arranged inside a print zone of the printhead assembly, and wherein the controller is to prevent spits when a print medium is present within the print zone.

12. A method for maintaining a printer, the method comprising:

moving a printhead assembly through a spit zone, the printhead assembly comprising nozzles to eject ink drops;

setting a starting position within the spit zone for a spit based on an ending position within the spit zone of a previous spit; and ejecting ink from the nozzles during a spit while the printhead assembly is moved through the spit zone, wherein the printhead assembly is moved through the spit zone during the spit to position the spit to not overlap the previous spit.

13. The method of claim 12, further comprising:

moving the printhead assembly at a first speed prior to reaching the spit zone, and wherein moving the printhead assembly through the spit zone comprises moving the printhead assembly through the spit zone at a second speed less than the first speed.

* * * * *